United States Patent [19]

Baseman

[11] Patent Number: 4,717,541

[45] Date of Patent: Jan. 5, 1988

[54] REACTION PRODUCT OF TRIFLUOROETHANOL AND A CYCLOHEXYLAMINE AND/OR A DICYCLOHEXYLAMINE

[76] Inventor: Maurice S. Baseman, 5905 Hobart St., Pittsburgh, Pa. 15217

[21] Appl. No.: 13,686

[22] Filed: Feb. 11, 1987

[51] Int. Cl.[4] ..... C23F 11/02

[52] U.S. Cl. ..... 422/7; 422/8; 422/9; 422/16; 252/392; 252/34; 252/51.5 R; 106/14.31; 564/307; 564/457; 564/462

[58] Field of Search ..... 252/392, 34, 51.5 R; 106/14.31; 422/7, 8, 9, 16; 564/307, 457, 462

[56] References Cited

U.S. PATENT DOCUMENTS

| | | | |
|---|---|---|---|
| 2,449,962 | 9/1948 | Wachter et al. | 252/51.5 R X |
| 2,544,245 | 3/1951 | Wachter et al. | 564/457 |
| 2,643,177 | 6/1953 | Wachter et al. | 252/392 X |
| 2,829,945 | 4/1958 | Krieg | 252/392 X |
| 3,169,116 | 2/1965 | Baseman | 106/14.31 X |
| 3,558,513 | 1/1971 | Baseman | 252/392 |
| 3,663,618 | 5/1972 | Baseman | 252/392 X |
| 4,455,247 | 6/1984 | Nakayama et al. | 252/67 |

FOREIGN PATENT DOCUMENTS

| | | | |
|---|---|---|---|
| 133689 | 1/1979 | German Democratic Rep. | 422/9 |
| 193377 | 11/1983 | Japan | 422/9 |

*Primary Examiner*—Matthew A. Thexton
*Attorney, Agent, or Firm*—Joseph J. Carducci

[57] ABSTRACT

A product having corrosion inhibiting properties consisting essentially of the reaction product of a triflouroethanol with a cyclohexylamine or with a mixture of cyclohexylamine and a dicyclohexylamine; a composition having corrosion inhibiting properties consisting essentially of a carrier liquid and disposed therein the reaction product of a triflouroethanol with a cyclohexylamine or with a mixture of a cyclohexylamine and a dicyclohexylamine; a combination of a solid body carrying thereon a product having corrosion inhibiting properties consisting essentially of the reaction product of a triflouroethanol with a cyclohexylamine or with a mixture of a cyclohexylamine and a dicyclohexylamine; and a process for inhibiting corrosion of metal surface by contacting the same with the reaction product of a triflouroethanol with a cyclohexylamine or with a mixture of a cyclohexylamine and a dicyclohexylamine.

31 Claims, No Drawings

REACTION PRODUCT OF TRIFLUOROETHANOL AND A CYCLOHEXYLAMINE AND/OR A DICYCLOHEXYLAMINE

BACKGROUND OF THE INVENTION

1. Field of the invention

This invention relates to a product having corrosion inhibiting properties consisting essentially of the reaction product of a triflouroethanol with a monocyclohexylamine, hereinafter referred to as "a cyclohexylamine," or a mixture of a cyclohexylamine and a dicyclohexylamine; a composition having corrosion inhibiting properties consisting essentially of a liquid carrier and disposed therein the reaction product of a triflouroethanol with a cyclohexylamine or with a mixture of a cyclohexylamine and a dicylohexylamine; a combination of a solid body carrying thereon a product having corrosion inhibiting properties consisting essentially of the reaction product of a triflouroethanol with a cyclohexylamine or with a mixture of a cyclohexylamine and a dicyclohexylamine; and a process for inhibiting corrosion of a metal surface by contacting the same with the reaction product of a triflouroethanol with a cyclohexylamine or with a mixture of a cyclohexylamine and a dicyclohexylamine.

2. Description of the Prior Art

The susceptibility of a metal surface to corrosion in the presence of water or in an atmosphere containing acidic components is well known. Thus the surfaces of metallic components in a closed system are susceptible to corrosion upon standing over a long period of time. For example, in an automobile engine, when not in use over a long period of time, as when the same is being transported, the inner surfaces thereof can be corroded because of the condensation of water or water vapor thereon or, if the engine has been previously operated, because of the acidic corrosion materials produced therein. It is common in shipping or storing items having metallic parts, such as heat exchangers, pipes, hydraulic cylinders, automotive parts, gasoline and diesel engines and the like, to coat the same with a mineral oil and then to wrap the coated item to form a closed container to reduce corrosion. However, coatings can flow from the verticle surfaces of such metal members so treated, as a function of time, temperature and gravity, to expose such surfaces to corrosion as a result of water and moisture formation on such surfaces, and acidic atmospheres contained therein.

In U.S. Pat. Nos. 3,558,513 and 3,663,618 to Maurice S. Baseman reaction products of hexaflouroisopropanol with cyclohexylamine, dicyclohexylamine or mixtures of the two have shown to posses corrosion inhibiting properties. However, the reaction products in these patents are crystalline materials. They are shown therein to be soluble in many carriers, for example, petroleum oil, tricresyl phosphates, mineral oil and water. Unfortunately, when these reaction products from such carriers are used, they will sublime from the surface of the carrier and recrystallize on any adjacent metal surface and form irregular coatings thereon, resulting in reduced corrosion protection thereon, or for example in a gasoline or diesel engine such recrystallization will result in clogging holes and and openings, such as fuel injector ports, resulting in unsatisfactory operation in such engines.

I have found in the present invention that the susceptibility of metal surfaces, in an open or closed system, to corrosion in the presence of condensed water or in an atmosphere containing acicic components, for example, from the combustion of a fuel, such as gasoline or a diesel fuel, can be inhibited or substantially reduced by the mere expedient of contacting such metal surface with the reaction product of a triflouroethanol with (1) a cyclohexylamine or (2) a mixture of a cyclohexylamine and a dicyclohexylamine.

SUMMARY OF THE INVENTION

I have found that the novel reaction product of a triflouroethanol with a cyclohexylamine or with a mixture of cyclohexylamine and a dicyclohexylamine posses corrosion inhibiting properties. These reaction products can be prepared simply by mixing a triflouroethanol with a cyclohexylamine or with a mixture of a cyclohexylamine and a dicyclohexylamine at ambient temperatures and pressures, for example, 72° F. and 14.7 pounds per square inch gage. The reaction proceeds rapidly, within about two to three minutes, with evolution of heat, and within a short time, for example, fifteen to twenty minutes, the reaction product returns to ambient temperature. The reaction product remains a liquid during the reaction period and after completion of the reaction. In use the product will volatalize at ambient conditions to form a corrosion inhibiting continous film on any metal body enclosed with the product in the vicinity thereof.

When the triflouroethanol is reacted with the cyclohexylamine to produce the novel reaction product, the triflouroethanol can be in the range of about 25 to about 75 parts by weight and the cyclohexylamine can range from about 75 to 25 parts by weight. Preferably they are admixed in the range of about 50 parts by weight each, that is in about stoichiometric amounts.

I have found that the product of a triflouroethanol with a dicyclohexylamine alone, though novel, will not function as a corrosion inhibitor in contact with a metal surface under test conditions as noted herein. However, I have also found, as stated above, that the novel reaction product of a triflouroethanol with a mixture of a cyclohexylamine and a dicyclohexylamine will function as a corrosion inhibitor in contact with a metal surface. When a triflouroethanol is reacted with a mixture of a cyclohexylamine and a dicyclohexylamine to form a reaction product that will function as a corrosion inhibitor, the triflouroethanol can be in the range of about 25 to about 75 parts by weight and the combined cyclohexylamine and dicyclohexylamine can range from about 75 to about 25 parts by weight, and preferably about 50 parts by weight of triflouroethanol and 50 parts by weight of the mixture of the cyclohexylamine and the dicyclohexylamine, with the latter mixture being composed of about 25 to about 85 weight percent of the cyclohexylamine and about 15 to about 75 weight percent of the dicyclohexylamine, and about preferably 50 to about 75 weight percent of the cyclohexylamine and about 50 to 25 weight percent of the dicyclohexylamine. As an example, using 2,2,2-triflouroethanol as the triflouroethanol and cyclohexylamine or dicyclohexylamine as the reactant therewith, I believe the novel products produced herein are cyclohexylammonium 2,2,2-triflouroethoxide, $[CF_3\ CH_2O^-]\ [(C_6H_{11})NH_3^+]$ and dicyclohexylammonium 2,2,2-triflouroethoxide $[CF_3\ CH_2\ O^-]\ [(C_6H_{11})_2NH2^+]$, respectively.

It is within the purview of my invention that one or more triflouroethanols, such as 2,2,2-triflouroethanol;

2,2,1-triflouroethanol; and 2,1,1-triflouroethanol can be reacted with cyclohexylamine or the mixture of cyclohexylamine and dicyclohexylamine to prepare the novel product therein. In a prefered embodiment, I use 2,2,2-triflouroethanol. Similarly, it is within the purview of my invention that not only the unsubstituted mono and the dicyclohexylamine can be reacted with the above triflouroethanols to obtain the novel products herein, but also cyclohexylamines and dicyclohexylamines wherein the hydrogens on the ring can be replaced with one or more normal or branched alkyls having from 1 to 6 carbon atoms, preferably methyl, cyclic alkyls and phenyl. Specific examples of cyclohexylamines that can be used include cyclohexylamine (CHA), methyl (CHA), isopropyl (CHA), phenyl (CHA), 1,3-dimethyl (CHA); examples of dicyclohexylamines that can be used include cyclohexylamine (DCHA), 2-methyl (DCHA), 3-isopropyl (DCHA), 1-phenyl (DCHA), 2,2-dimethyl (DCHA), 10-isobutyl (DCHA), 1,10-diethyl (DCHA), 2-hexyl (DCHA), 12-isopropyl (DCHA), 1-methyl, 8-ethyl (DCHA), 3-pentyl, 11 ethyl (DCHA), 4-methyl, 5-cyclohexyl (DCHA), 1,3,7-trimethyl (DCHA), 1,2,3,8,10,11-hexamethyl (DCHA), etc.

The novel reaction products defined above can be used as corrosion inhibitors, since they are liquids; they can also vaporize to form continuous films on metal surfaces to protect the same.

In one embodiment the novel reaction products defined above can be applied to any solid body, either as a coating thereon or as an impregnant, and said solid body can serve as a carrier thereof. Such solid bodies can include paper, cloth, felt of cotton, wool, rayon or nylon, plastics such as polyethylene, polyurethane, polyvinyl acetate, polyvinal chloride and the like. Such solid bodies carrying the novel reaction products can therefore serve as a base from which the novel reaction products can volatilize therefrom to form vapors that can condense on a adjacent metal surface to function as a corrosion inhibitor. Additionally, some of these solid bodies carrying the novel reaction products, for example, a fiberous material, such as paper or cloth, can be used as a wrapping or a cover for ferrous metals to be stored or transported to prevent rusting thereof.

In a preferred embodiment, the novel reaction products can be disolved in many suitable liquid carriers, including water, but particularly in an oleaginous vehicle, preferably a relatively non-volatile fluid having a viscosity between about 60 to 1,000 saybolt universal seconds (SUS), and preferably between about 60 to about 800 (SUS) at 25° C. Suitable vehicles include petroleum hydrocarbon oils, such as paraffinic and naphthenic oils; kerosene and gasoline; greases; hydraulic fluids; vegetable oils, such as castor oil and soybean oil; synthetic oils, such as long chain esters of dibasic acids, for example bis(2-ethylhexyl) sebacates, and the like, and neopentyl polyols, known as Mobil Jet Oil II, and sold by Mobil Oil Corp., defined in military specifications as MIL-L-23699. The amount of the novel reaction product carried by the liquid carriers can vary over a wide range, for example from about 0.1 weight percent to more than 10 weight percent, preferably from about 0.2 weight percent to about 3 weight percent, based on the weight of the carrier.

The novel composition defined above, including the liquid carrier, particularly when the liquid carrier is an oleagenois vehicle, is especially effective when the same is used in a closed system or container, such as defined above, to protect the metal surfaces in such a system from corrosion. In such case, the novel reaction product will tend to volatilize until the free space in the closed system or container is saturated therewith. The vapors will then coat the metal surface, or if the metal surface is wet with water, will displace or permeate the same, thereby to provide a corrosion inhibiting coating thereon. Since the free space is confined, the novel reaction product cannot easily escape therefrom and therefore will be available for extremely long periods of time, for example, up to a year and even more, to exert its anticorrosion properties on the metal surface. The closed system can be any system, relatively permanent, as in an internal combustion engine, or semipermanent, as in a package used in shipping metal parts.

The metal surfaces protected by the novel reaction products herein include steel, cast iron, copper, brass, and aluminum.

The novel reaction products or novel compositions carrying the same can include other carrier liquids such as synthetic polyesters, for example, diethylene glycoladipate, monohydric alcohols, such as ethyl or propyl alcohol, and glycols, admixed in any and all proportions with each other, silicone oils, such as dimethyl polysiloxanes, and flourocarbon liquids. These additional carrier fluids can be used with at least about 0.1 weight percent and as high as about 10 weight percent of the novel reaction product. Additionally, nitrites, nitrates, phosphates, and chromates as inhibitors can be present.

DESCRIPTION OF PREFERRED EMBODIMENTS

The following will further illustrate the invention defined and claimed herein.

EXAMPLE NO. 1

Ten grams of 2,2,2-triflouroethanol were admixed with 10 grams of cyclohexylamine at 72° F. and at atmospheric pressure in a glass test tube having a height of 125 millimeters and a diameter of 25 millimeters. An exothermic reaction resulted raising the temperature from 72° F. to 127° F. over a period of about 2 minutes. After about 15 minutes the temperature of the resulting reaction product returned to 72° F. The reaction product was a water white clear liquid having a boiling point of 250° F. (Cottrell Boiling Point Apparatus), a flash point of 145° F. to 150° F. (Cleveland Open Cup), and the pour point was approximately 6° F. (ASTM D97).

EXAMPLE NO. 2

Ten grams of 2,2,2-trifluorethanol were admixed with a mixture composed of 7.5 grams of cyclohexylamine and 2.5 grams of dicyclohexylamine at 72° F. and atmospheric pressure in a test tube similar to that used in Example No. 1. An exothermic reaction resulted, raising the temperature from 72° F. to 113° F. over a period of about 2 minutes. After about 15 minutes the temperature of the resulting reaction product returned to 72° F. The reaction product was a water white clear liquid having a boiling point of approximately 215° F. (Cottrell Boiling Point Apparatus), a flash point of 140° F. to 145° F. (Cleveland Open Cup), and the pour point was approximately 45° F. (ASTM D97).

EXAMPLE NO. 3

The procedure of Example No. 2 was repeated except that the reactants consisted of 7.8 grams of 2,2,2-trifluorethanol and 12.8 grams of dicyclohexylamine. An exothermic reaction resulted, raising the temperature from 72° F. to 131° F. over a period of about 2 minutes and resulting in the formation of a solid body of crystalline material. After about 20 minutes the temperature of the reaction product returned to 72° F., with the crystalline material still being present. The boiling point of the reaction product was approximately 250° F. (Cottrell Boiling Point Apparatus), the flash point was 180° F. (Cleveland Open Cup), and the melting point was 117° F. (capillary tube).

The vapor phase testing in the following Examples No. 4 to Example No. 6 was carried out using apparatus proposed by ASTM Task Group C-II (Vapor Phase Test Apparatus available from Koehler Instrument Co., Inc., Bohemia, N.Y.; composed of the following: 1018 steel coupons 1 inch long and 0.5 inch diameter; a teflon sleeve 2½ inches long having an internal diameter of ¾ inch, a tapered neck 250 milliliter glass flask; and a specimen cup for holding the test oil 2 and ¾ inches long and 1 inch in diameter with 11 holes each 1 millimeter in diameter, spaced equidistant from each other in the wall of the cup, 1 and ⅛ inch from the bottom of the cup, to admit water vapors therein. A stainless steel specimen holder approximately 4 inches long and ⅜ inches in diameter, and threaded on one end to screw in the test coupon and having on the other end an inlet and an outlet port, which can be attached to tubes for the introduction of circulating water), was used. The steel specimen holder was inserted into the teflon sleeve, the steel coupon was screwed into one end of the stainless steel holder, with a teflon washer applied thereon to prevent slipping of the coupon through the teflon sleeve, and the oil specimen cup was slipped over the teflon sleeve and held tight by an "O" ring, so that the test coupon did not touch the test oil. This apparatus was then placed in the flask where the teflon sleeve formed an air-tight seal with the tapered neck of the flask. Hoses were attached to the inlet and outlet ports on the other end of the stainless steel holder and cooling water was circulated therein. The flask was then lowered into a heated water bath and held in place with clamps.

EXAMPLE NO. 4

A reaction product was prepared using 50 parts by weight of cyclohexylamine and 50 parts by weight of 2,2,2-trifluorethanol following the procedure of Example No. 1. A mixture was prepared using the above reaction product and Military Specification Oil, MIL-L-21260, Grade 30, Lubricating Oil, Internal Combustion Engine, Preservative and Break In such that the resulting mixture contained 0.3 weight percent of the reaction product. Two grams of this mixture was placed in the test cup of the proposed ASTM apparatus described above. Two grams of the neat oil, MIL-L-21260, were placed in another test cup of the proposed ASTM apparatus. The test samples were placed in a water bath and held at 130° F. for 16 hours. Cooling water, maintained at 70° F., was circulated through the steel test coupon holder. At the end of the 16 hour period, 5 milliliters of distilled water was placed in the apparatus flask. The above conditions were then maintained for another six hours. At the end of the six hour period the steel coupons were removed and examined for corrosion. The specimen over the neat oil was heavily rusted, while the specimen over the cup with the novel reaction product defined above was essentially free from rust.

EXAMPLE NO. 5

A reaction product was prepared using 50 parts by weight of 2,2,2-trifluoroethanol and 50 parts by by weight of a mixture composed of 75 weight percent cyclohexylamine and 25 weight percent dicyclohexylamine following the procedure of Example No. 2. A mixture was prepared using the above reaction product and Kendall 10W-30W Motor Oil, such that the resulting mixture contained 0.5 weight percent of the above reaction product. Two grams of this mixture were placed in the specimen cup of the proposed ASTM apparatus described above. Two grams of the Kendall 10W-30W Motor Oil neat were placed in another specimen cup. The flasks were held at 130° F. for 16 hours with cooling water maintained at 70° F. circulated to the steel specimen holder. At the end of this period, five milliliters of distilled water were added to the flask and the test was continued for an additional six hours. At the end of the six hour period, the steel coupons were removed and examined for signs of rusting. The steel coupon in the neat oil was found to be heavily rusted, while the coupon in the cup containing the oil and the reaction product was essentially free from rust.

EXAMPLE NO. 6

The work described in Example No. 4 was repeated, except that the reaction product was prepared using 36 parts by weight of 2,2,2-trifluoroethanol and 64 parts by weight of dicyclohexylamine. As in Example No. 4, the MIL-L-21260, Grade 30 Lubricating Oil contained 0.3 weight percent of the above reaction product. The results of this test indicated no significant difference between the use of the neat oil and the oil containing the above reaction product, for in each case the test specimens were both heavily rusted.

The results obtained in Examples No. 4, 5, and 6 are quite unusual. when the triflouroethanol was reacted with the cyclohexylamine in Example No. 4, the reaction product proved to be an excellent vapor phase corrosion inhibitor for metals, while in Example No. 6 the reaction product of the triflouroethanol with the dicyclohexylamine proved to be an ineffective corrosion inhibitor in the vapor phase. And yet when the reaction product of Example No. 5 using the triflouroethanol and both of the amines were used, excellent corrosion inhibiting properties in the vapor phase was found to be the case. This may be due to the fact as evidenced by Example No. 3, that the reaction product of triflouroethanol and the dicyclohexylamine alone is a crystalline material. When both cyclohexylamine and dicyclohexylamine are used in the reaction with triflouroethanol, apparantly the components of the reaction product relate synergestically with each other to form the clear, water-white product of Example No. 2.

EXAMPLE NO. 7

A mixture was prepared composed of 150 milliliters of distilled water and 0.3 weight percent thereof of the reaction product of Example No. 1. This mixture was placed in a jar 4 inches high and having a diameter of 3.25 inches. Another similar jar contains only 150 milliliters of distilled water. Submerged in each jar was a polished 1020 steel panel 2.5 inches high, 1.25 inches wide and ⅛ inch thick. The lid was screwed onto each jar and the edges of the jar and the lid were sealed with contact tape. The jars were then placed into an electric oven and held therein at 130° F. for 16 hours. At the end of this time the steel panels were removed and examined for rusting. The specimen submerged in the water containing the reaction product of Example No. 1 was essentially free from rusting, while the specimen in the neat water showed numerous rust spots.

Obviously many modifications and variations of the invention, as hereinabove set forth, can be made without departing from the spirit and scope thereof and therefore only such limitations should be imposed as are indicated in the appended claims.

I claim:

1. A composition having corrosion inhibiting properties consisting essentially of a carrier liquid and disposed therein; about 0.1 to about 10 weight percent of a product selected from the group consisting of (1) the reaction product of a triflouroethanol with a cyclohexylamine and (2) the reaction product of a triflouroethanol with a mixture of a cyclohexylamine and a dicyclohexylamine.

2. The composition of claim 1, wherein the product is the reaction product of a triflouroethanol with a cyclohexylamine.

3. The composition of claim 2, wherein the triflouroethanol is 2,2,2-triflouroethanol and the cyclohexylamine is cyclohexylamine.

4. The composition of claim 2, wherein the reaction product is obtained using from about 25 to about 75 parts by weight of the triflouroethanol and about 75 to about 25 parts by weight of the cyclohexylamine.

5. The composition of claim 2, wherein the reaction product is obtained using from about 50 parts by weight of the triflouroethanol and about 50 parts by weight of the cyclohexylamine

6. The composition of claim 11, wherein the product is the reaction product of a triflouroethanol with a mixture of a cyclohexylamine and a dicyclohexylamine.

7. The composition of claim 6, wherein the triflouroethanol is 2,2,2-triflouroethanol, the cyclohexylamine is cyclohexylamine and the dicyclohexylamine is dicyclohexylamine.

8. The composition of claim 6, wherein the reaction product is obtained from using about 25 to about 75 parts by weight of the triflouroethanol and from about 75 to about 25 parts by weight of the mixture of cyclohexylamine and dicyclohexylamine, with said latter mixture being composed of about 25 to about 85 weight percent of the cyclohexylamine and about 15 to about 75 weight percent of the dicyclohexylamine.

9. The composition of claim 6, wherein the reaction product is obtained using from about 50 parts by weight of the triflouroethanol and about 50 parts by weight of the combined mixture of the cyclohexylamine and the dicyclohexylamine, with the said latter mixture being composed of about 50 to about 75 weight percent of the cyclohexylamine and about 25 to about 50 weight percent of the dicyclohexylamine.

10. The composition of claim 1 wherein said carrier is an oleaginous liquid.

11. A combination of a solid body carrying thereon a product having corrosion inhibiting properties selected from the group consisting of (1) the reaction product of a triflouroethanol with a cyclohexylamine and (2) the reaction product of a triflouroethanol with a mixture of a cyclohexylamine and a dicyclohexylamine.

12. The combination of claim 11 wherein the product is the reaction product of a triflouroethanol and a cyclohexylamine.

13. The combination of claim 12 wherein the triflouroethanol is 2,2,2-triflouroethanol and the cyclohexylamine is cyclohexylamine.

14. The combination of claim 12 wherein the reaction product is obtained from using from about 25 to about 75 parts by weight of the triflouroethanol and about 75 to about 25 parts by weight of the cyclohexylamine.

15. The combination of claim 12 wherein the reaction product is obtained using from about 50 parts by weight of the triflouroethanol and about 50 parts by weight of the cyclohexylamine.

16. The combination of claim 11 wherein the product is the reaction product of a triflouroethanol with a mixture of a cyclohexylamine and a dicyclohexylamine.

17. The combination of claim 16 wherein the triflouroethanol is 2,2,2-triflouroethanol, and the cyclohexylamine is cyclohexylamine and the dicyclohexylamine is dicyclohexylamine.

18. The combination of claim 16 wherein the reaction product is obtained using from about 25 parts by weight to about 75 parts by weight of the triflouroethanol and from about 75 to about 25 parts by weight of the combined mixture of the cyclohexylamine and the dicyclohexylamine, with said latter mixture being composed of about 25 to about 85 weight percent of the cyclohexylamine and about 15 to about 75 weight percent of the dicyclohexylamine.

19. The combination of claim 16 wherein the reaction product is obtained using from about 50 parts by weight of the triflouroethanol and about 50 parts by weight of the combined mixture of the cyclohexylamine and dicyclohwzylmine, with said latter mixture being composed of about 50 to about 75 weight percent of the cyclohexylamine and about 25 to about 50 weight percent of the dicyclohexylamine.

20. A process for inhibiting corrosion of a metal surface which comprises contacting said metal surface with; composition consisting essentially of a carrier liquid and about 0.1 to about 10 weight percent of a product selected from the group consisting of (1) the reaction product of a triflouroethanol with a cyclohexylamine and (2) the reaction product of a triflouroethanol with a mixture of a cyclohexylamine and a dicyclohexylamine.

21. The process of claim 20 wherein the product is the reaction product of a triflouroethanol with a cyclohexylamine.

22. The process of claim 21 wherein the triflouroethanol is 2,2,2-triflouroethanol and the cyclohexylamine is cyclohexylamine.

23. The process of claim 21 wherein the reaction product is obtained using from about 25 to about 75 parts by weight of the triflouroethanol and about 75 to about 25 parts by weight of the cyclohexylamine.

24. The process of claim 21 wherein the reaction product is obtained using from about 50 parts by weight of the triflouroethanol and about 50 parts by weight of the cyclohexylamine.

25. The process of claim 20 wherein the product is the reaction product of a triflouroethanol with a mixture of a cyclohexylamine and a dicyclohexylamine.

26. The process of claim 25 wherein the triflouroethanol is 2,2,2-triflouroethanol, the cyclohexylamine is cyclohexylamine and the dicyclohexylamine is dicyclohexylamine.

27. The process of claim 25 wherein the reaction product is obtained using from about 25 to about 75 parts by weight of the triflouroethanol and from about 75 to about 25 parts by weight of the combined mixture of the cyclohexylamine and the dicyclohexylamine, with said latter mixture being composed of about 25 to about 85 weight percent of the cyclohexylamine and about 15 to about 75 weight percent of the dicyclohexylamine.

28. The process of claim 25 wherein the reaction product is obtained using from about 50 parts by weight of the triflouroethanol and about 50 parts by weight of the combined mixture of the cyclohexylamine and dicyclohexylamine, with said latter mixture being composed of about 50 to about 75 weight percent of the cyclohexylamine and about 25 to about 50 weight percent of the dicyclohexylamine.

29. The process of claim 20 wherein said metal surfaces to be protected are in a closed system and said product is maintained within said closed system disposed within a carrier liquid.

30. The process of claim 29 wherein said carrier liquid is paraffinic or naphthanic petroleum oil.

31. The process of claim 20 wherein said metal surface is made of steel.

* * * * *

UNITED STATES PATENT AND TRADEMARK OFFICE

CERTIFICATE OF CORRECTION

PATENT NO. : 4, 717,541

DATED : January 5, 1988

INVENTOR(S) : Maurice S. Baseman

It is certified that error appears in the above-identified patent and that said Letters Patent is hereby corrected as shown below:

Column 3, line 17, "cyclohexylamine" should read "dicyclohexylamine".

Column 6, line 38, change "when" to "When".

Column 7, claim 6, line 1 thereof, change "11" to "1".

Column 8, lines 31 and 32, in claim 19, change "dicyclohwzylamine" to "dicyclohexylamine".

Signed and Sealed this

Seventh Day of June, 1988

*Attest:*

*Attesting Officer*

DONALD J. QUIGG

*Commissioner of Patents and Trademarks*